US011041406B2

(12) United States Patent
Wang et al.

(10) Patent No.: US 11,041,406 B2
(45) Date of Patent: Jun. 22, 2021

(54) INLET GUIDE VANE ASSEMBLY OF GAS TURBINE AND GAS TURBINE

(71) Applicant: Siemens Aktiengesellschaft, Munich (DE)

(72) Inventors: Yang Wang, Shanghai (CN); Hong Yun Lv, Shanghai (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 51 days.

(21) Appl. No.: 16/609,568

(22) PCT Filed: Apr. 20, 2018

(86) PCT No.: PCT/EP2018/060142
§ 371 (c)(1),
(2) Date: Oct. 30, 2019

(87) PCT Pub. No.: WO2018/202441
PCT Pub. Date: Nov. 8, 2018

(65) Prior Publication Data

US 2020/0063605 A1 Feb. 27, 2020

(30) Foreign Application Priority Data

May 2, 2017 (CN) ..... 201720478719.5

(51) Int. Cl.
*F01D 25/24* (2006.01)
*F01D 17/16* (2006.01)

(52) U.S. Cl.
CPC ..... *F01D 25/246* (2013.01); *F01D 17/162* (2013.01); *F05D 2220/32* (2013.01)

(58) Field of Classification Search
CPC ..... F01D 25/246; F01D 17/162; F01D 9/042; F05D 2220/32
See application file for complete search history.

(56) References Cited

U.S. PATENT DOCUMENTS 6,450,763 B1 * 9/2002 Crum ..... F01D 9/042 29/889.22
2010/0310358 A1 12/2010 Major et al.
(Continued)

FOREIGN PATENT DOCUMENTS

EP 1207272 A2 5/2002
EP 3032037 A1 6/2016
JP 2002195195 A 7/2002

OTHER PUBLICATIONS

International Search Report PCT/ISA/210 for International Application No. PCT/EP2018/060142 dated Sep. 24, 2018.
(Continued)

*Primary Examiner* — Shafiq Mian
(74) *Attorney, Agent, or Firm* — Harness, Dickey & Pierce, P.L.C.

(57) ABSTRACT

An inlet guide vane assembly of gas turbine is disclosed. The inlet guide vane assembly includes: a plurality of inlet guide vanes, each including a fixing shaft disposed at the end away from a fixing part; and a fixing assembly including a support ring, a fixing ring and an abutting member. The fixing ring includes a fixing wall facing towards a support part, the fixing wall forming, in cooperation with a support wall, a plurality of accommodating cavities corresponding to the plurality of inlet guide vanes. The fixing shafts are rotatably inserted into the accommodating cavities, and the abutting member is in interference fit with the inner inlet casing and the fixing ring. The inlet guide vane assembly implements support for the inlet guide vanes without affecting installation of the inlet guide vanes.

14 Claims, 6 Drawing Sheets

(56) References Cited

U.S. PATENT DOCUMENTS

| | | | | |
|---|---|---|---|---|
| 2015/0003968 | A1* | 1/2015 | Maliniak | F02C 7/04 415/151 |
| 2016/0146027 | A1 | 5/2016 | Humhauser et al. | |
| 2019/0093511 | A1* | 3/2019 | Nett | F01D 25/243 |

OTHER PUBLICATIONS

Written Opinion of the International Searching Authority PCT/ISA/237 for International Application No. PCT/EP2018/060142 dated Sep. 24, 2018.

International Preliminary Report on Patentability for International Application No. PCT/EP2018/060142 dated Apr. 16, 2019.

Japanese Office Action and English translation thereof dated Nov. 30, 2020.

* cited by examiner

INLET GUIDE VANE ASSEMBLY OF GAS TURBINE AND GAS TURBINE

PRIORITY STATEMENT

This application is the national phase under 35 U.S.C. § 371 of PCT International Application No. PCT/EP2018/060142, which has an International filing date of Apr. 20, 2018, which designated the United States of America, and which claims priority to Chinese Patent Application No. CN 201720478719.5 filed May 2, 2017, the entire contents of which are hereby incorporated herein by reference.

FIELD

Embodiments of invention generally relate to an inlet guide vane assembly, in particular to an inlet guide vane assembly of a gas turbine, and a gas turbine having the above-mentioned inlet guide vane assembly.

BACKGROUND

In existing gas turbines, inlet guide vanes are usually installed on an inlet cover of a compressor of the gas turbine to facilitate installation and maintenance. When the inlet guide vanes are to be installed, it is required to insert the inlet guide vanes into an outer casing of the inlet cover of the compressor in a radial direction, so it is necessary to cut an inner casing of the inlet cover to provide installation space. After the inlet guide vanes are installed, there is no support from the inlet casing, so that the part of the inlet guide vanes which is inserted into the outer inlet casing of the compressor is easily deformed and damaged due to bearing all the support force.

SUMMARY

At least one embodiment of the present invention is directed to providing an inlet guide vane assembly of a gas turbine, which can support the inlet guide vanes at an inlet cover to prevent the inlet guide vanes from being deformed and damaged.

At least one embodiment of the present invention is directed to providing a gas turbine capable of supporting inlet guide vanes at an inlet cover to prevent the inlet guide vanes from being deformed and damaged.

According to the inlet guide vane assembly of a gas turbine of at least one embodiment of the present invention, the gas turbine comprises an inner inlet casing and an outer inlet casing, the outer inlet casing is sheathed outside the inner inlet casing, the outer inlet casing comprises a cylindrical fixing part, and the inlet guide vane assembly comprises a plurality of inlet guide vanes and a fixing assembly. One end of each of the inlet guide vanes is rotatably connected to a first fixing part, each of the inlet guide vanes is rotatable in a radial direction of the fixing part, and each of the inlet guide vanes comprises a fixing shaft which is disposed at the end away from fixing part. The fixing assembly comprises a support ring, a fixing ring and an abutting member. The support ring can be coaxially fixed to the inner inlet casing with the fixing part, wherein the support ring comprises a support part formed by radially extending from an outer surface of the support ring, and the support part comprises a support wall facing towards the inner inlet casing. The fixing ring is sheathed on the outer surface of the support ring and located between the inner inlet casing and the support part, wherein the fixing ring comprises a fixing wall facing towards the support part, the fixing wall can form, in cooperation with the support wall, a plurality of accommodating cavities corresponding to the plurality of inlet guide vanes after making contact with the support wall, and the fixing shafts are rotatably inserted into the accommodating cavities. The abutting member is disposed between the inner inlet casing and the fixing ring in an axial direction of the support ring, and the abutting member is in interference fit with the inner inlet casing and the fixing ring.

At least one embodiment of the present invention further provides a gas turbine, comprising an inner inlet casing, an outer inlet casing and an inlet guide vane assembly as described above. The outer inlet casing is sheathed outside the inner inlet casing and comprises a cylindrical fixing part. One end of each of the inlet guide vanes is rotatably connected to the first fixing part, each of the inlet guide vanes is rotatable in a radial direction of fixing part, and the support ring is fixed to the inner inlet casing.

BRIEF DESCRIPTION OF THE DRAWINGS

The following drawings are only to schematically describe and explain the present invention, and do not limit the scope of the present invention.

LIST OF REFERENCE SIGNS

Figure 1:
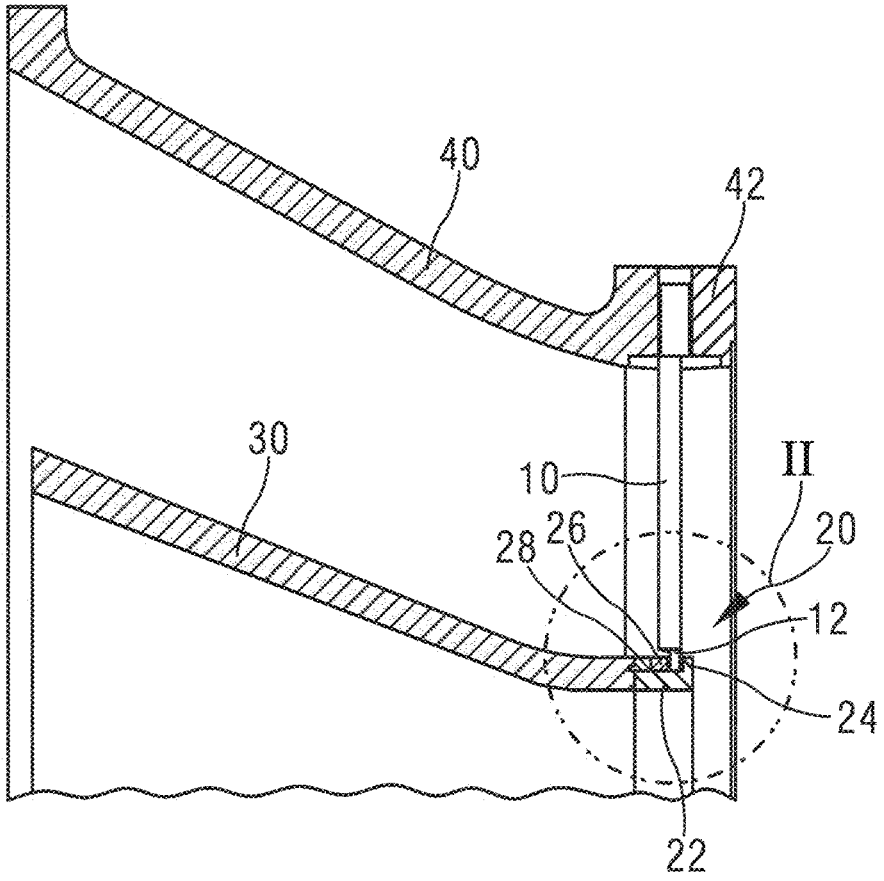
FIG. 1 is a cross-sectional structural schematic diagram for illustrating an example embodiment of an inlet guide vane assembly.

10 Inlet guide vane
12 Fixing shaft
20 Fixing assembly
21 Accommodating cavity
22 Support ring
24 Support part
25 Support wall
252 First groove
26 Fixing ring
27 Fixing wall
272 Second groove
28 Abutting member
29 Raised edge
30 Inner inlet casing
40 Outer inlet casing
42 Fixing part
50 Bolt

DETAILED DESCRIPTION OF EMBODIMENTS

According to the inlet guide vane assembly of a gas turbine of at least one embodiment of the present invention, the gas turbine comprises an inner inlet casing and an outer inlet casing, the outer inlet casing is sheathed outside the inner inlet casing, the outer inlet casing comprises a cylindrical fixing part, and the inlet guide vane assembly comprises a plurality of inlet guide vanes and a fixing assembly. One end of each of the inlet guide vanes is rotatably connected to a first fixing part, each of the inlet guide vanes is rotatable in a radial direction of the fixing part, and each of the inlet guide vanes comprises a fixing shaft which is disposed at the end away from fixing part. The fixing assembly comprises a support ring, a fixing ring and an abutting member. The support ring can be coaxially fixed to the inner inlet casing with the fixing part, wherein the support ring comprises a support part formed by radially extending from an outer surface of the support ring, and the support part comprises a support wall facing towards the inner inlet casing. The fixing ring is sheathed on the outer surface of the support ring and located between the inner inlet casing and the support part, wherein the fixing ring comprises a fixing wall facing towards the support part, the fixing wall can form, in cooperation with the support wall, a plurality of accommodating cavities corresponding to the plurality of inlet guide vanes after making contact with the support wall, and the fixing shafts are rotatably inserted into the accommodating cavities. The abutting member is disposed between the inner inlet casing and the fixing ring in an axial direction of the support ring, and the abutting member is in interference fit with the inner inlet casing and the fixing ring.

The inlet guide vane assembly provided by at least one embodiment of the present invention has a detachable fixing assembly, implements support for two ends of each inlet guide vane by cooperating with the fixing shafts of the inlet guide vanes without affecting installation of the inlet guide vanes, and prevents the inlet guide vanes from deformation and damage.

In a further example embodiment of the inlet guide vane assembly, the support ring and the fixing ring are respectively assembled by two semi-rings.

In another example embodiment of the inlet guide vane assembly, the abutting member is a metal strip wound around the support ring.

In another example embodiment of the inlet guide vane assembly, a raised edge extending towards the inner inlet casing is formed on the abutting member, and the raised edge can be embedded into the inner inlet casing, so as to further fix the abutting member and prevent the abutting member from being disengaged from a support member. In another example embodiment of the inlet guide vane assembly, the support wall comprises a plurality of first grooves, and the fixing wall comprises a plurality of second grooves corresponding to the plurality of first grooves, the first grooves and the second grooves cooperating to form the accommodating cavities.

In another example embodiment of the inlet guide vane assembly, a sleeve is disposed within the accommodating cavity, and the fixing shaft extends through the sleeve, so as to facilitate the rotation of the fixing shaft inside the accommodating cavity.

In another example embodiment of the inlet guide vane assembly, the support ring is fixed to the inner inlet casing via a bolt.

At least one embodiment of the present invention further provides a gas turbine, comprising an inner inlet casing, an outer inlet casing and an inlet guide vane assembly as described above. The outer inlet casing is sheathed outside the inner inlet casing and comprises a cylindrical fixing part. One end of each of the inlet guide vanes is rotatably connected to the first fixing part, each of the inlet guide vanes is rotatable in a radial direction of fixing part, and the support ring is fixed to the inner inlet casing.

In the following, preferred embodiments will be described in a clear and understandable manner with reference to the accompanying drawings, which further describe the above characteristics, technical features, advantages and implementations of the inlet guide vane assembly and the gas turbine.

In order to facilitate clearer understanding of the technical features, objectives and effects of the present invention, particular embodiments of the present invention are now described with reference to the drawings. The same reference signs in the drawings denote components having the same structure, or similar structure but having the same function. Herein, "example" means "serving as an example, instance or illustration", and any illustration or embodiment described herein as "example" should not be interpreted as a more preferred or more advantageous technical solution.

FIG. 1 is a cross-sectional structural schematic diagram for illustrating an example embodiment of an inlet guide vane assembly. With reference to FIG. 1, a gas turbine comprises an inner inlet casing 30 and an outer inlet casing 40, the outer inlet casing 40 is sheathed outside the inner inlet casing 30, and the outer inlet casing 40 comprises a cylindrical fixing part 42. The inlet guide vane assembly comprises a plurality of inlet guide vanes 10 and a fixing assembly 20.

Figure 2:
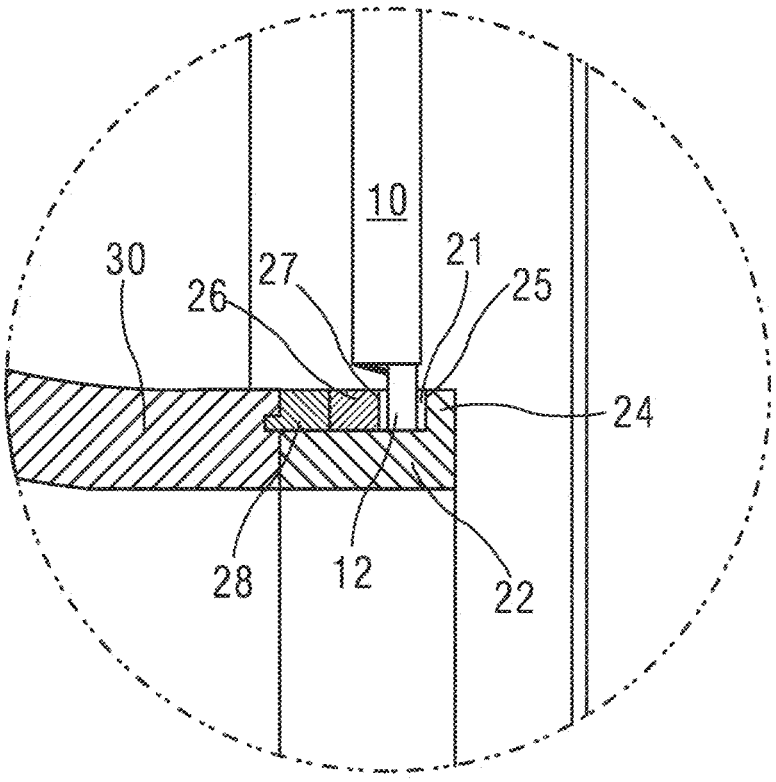
FIG. 2 is a partially enlarged schematic diagram for illustrating an example embodiment of an inlet guide vane assembly.

FIG. 2 is a partially enlarged diagram of FIG. 1.

Figure 3:
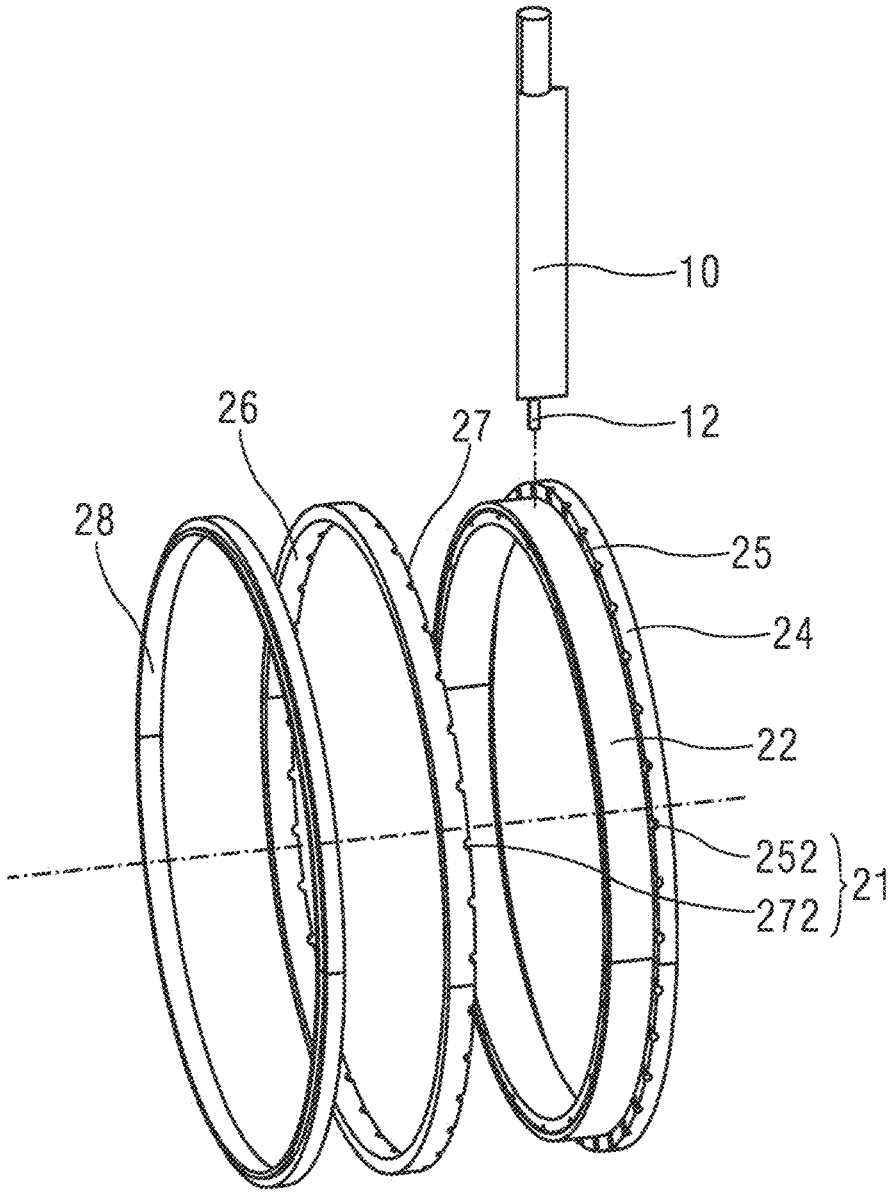
FIG. 3 is an exploded structural schematic diagram for illustrating an example embodiment of an inlet guide vane assembly.

FIG. 3 is an exploded structural schematic diagram for illustrating an example embodiment of an inlet guide vane assembly.

With reference to FIGS. 2 and 3 and in conjunction with FIG. 1, one end of each of the inlet guide vanes 10 is rotatably connected to a first fixing part, each of the inlet guide vanes 10 is rotatable in a radial direction of the fixing part 42, each of the inlet guide vanes 10 comprises a fixing shaft 12 which is disposed at the end away from fixing part 42. The fixing assembly 20 comprises a support ring 22, a fixing ring 26 and an abutting member 28. The support ring 22 can be coaxially fixed to the inner inlet casing 30 with the fixing part 42, wherein the support ring 22 comprises a support part 24 formed by radially extending from an outer surface of the support ring 22, and the support part 24 comprises a support wall 25 facing towards the inner inlet casing 30. The fixing ring 26 is sheathed on the outer surface of the support ring 22 and located between the inner inlet casing 30 and the support part 24, wherein the fixing ring 26 comprises a fixing wall 27 facing towards the support part 24, the fixing wall 27 can form, in cooperation with the support wall 25, a plurality of accommodating cavities 21 corresponding to the plurality of inlet guide vanes 10 after making contact with the support wall 25, and the fixing shafts 12 are rotatably inserted into the accommodating cavities 21. The abutting member 28 is disposed between the inner inlet casing 30 and the fixing ring 26 in an axial direction of the support ring, and the abutting member 28 is in interference fit with the inner inlet casing 30 and the fixing ring 26.

Figure 4:
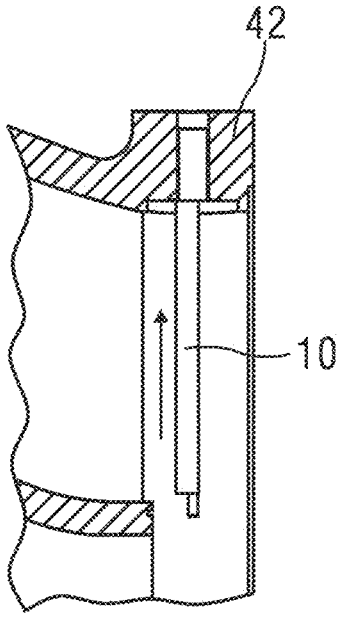
FIG. 4 is an assembly schematic diagram for illustrating an example embodiment of an inlet guide vane assembly.
Figure 5:
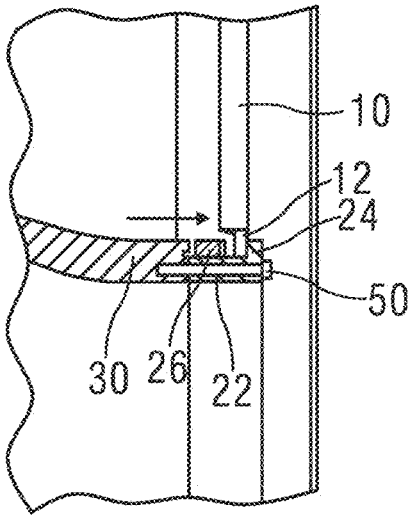
FIG. 5 is an assembly schematic diagram for illustrating another state of an example embodiment of an inlet guide vane assembly.

FIGS. 3 to 5 are assembly schematic diagrams of the inlet guide vane assembly.

Figure 6:
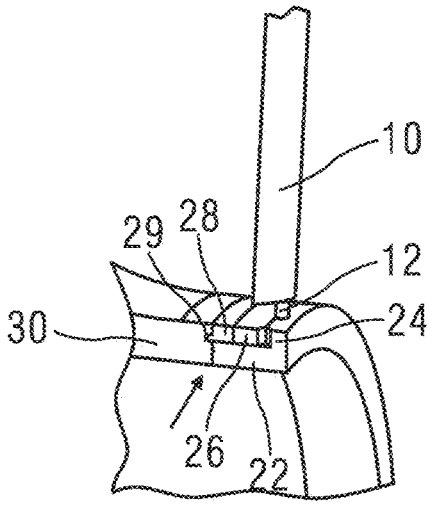
FIG. 6 is an assembly schematic diagram for illustrating another state of an example embodiment of an inlet guide vane assembly.

With reference to FIG. 4, when the inlet guide vane assembly is to be mounted, the inlet guide vanes 10 (only one of which is shown in the figure) are firstly installed in a radial direction of the fixing part 42, as indicated by the arrow in the figure. Then, the support ring 22 is installed, with reference to FIG. 5. After the support ring 22 is installed in place, the fixing ring 24 is installed on the surface of the support ring. In an example embodiment, the support ring 22 and the fixing ring 26 are assembled by two semi-rings. Firstly, the two semi-rings forming the support ring 22 are fixed to the inner inlet casing 40 by a bolt 50 as shown in the figure. Then, the two semi-rings forming the fixing ring 26 are installed in the surface of the support ring 22. After the fixing ring 26 is installed, the fixing ring 26 is pushed along the arrow in FIG. 5, such that the fixing wall 27 of the fixing ring 26 abuts against the support wall 25 of the support ring 22. At this time, the fixing shafts 12 of the inlet guide vanes 10 are rotatably fixed in the accommodating cavities 21 under cooperation between the support wall 25 and the fixing wall 27. With reference to FIG. 6, the abutting member 28 is installed after the fixing shafts of the inlet guide vanes 10 are fixed. In an example embodiment, The abutting member 28 is a metal strip which is inserted between the inner inlet casing 30 and the fixing ring in the direction shown by the arrow in FIG. 6 after contraction caused by cold treatment, surrounds the outer surface of the support ring 22, and is in interference fit with the inner inlet casing 30 and the fixing ring 26, so as to fix the fixing ring 26.

In an example embodiment, with reference to FIG. 6, a raised edge 29 extending towards the inner inlet casing 40 is formed on the abutting member 28, and the raised edge 29 is embedded into the inner inlet casing 40. The raised edge further fixes the abutting member and prevents the abutting member from being disengaged from the support member.

In an example embodiment, with reference to FIG. 2, the support wall 24 comprises a plurality of first grooves 252 (only one of which is shown in the figure), the fixing wall 27 comprises a plurality of second grooves 272 (only one of which is shown in the figure) corresponding to the plurality of first grooves 252, the first grooves 252 and the second grooves 272 cooperating to form the accommodating cavities 21. In an example embodiment, the first groove 252 and the second groove 272 are semi-cylindrical grooves, respectively, and are aligned to form a cylindrical accommodating cavity 21, but not limited thereto. In other example embodiments, the first groove 252 and the second groove 272 may also be other shapes that facilitate the insertion of the fixing shaft 12.

In an example embodiment, a sleeve is disposed within the accommodating cavity 21, and the fixing shaft 12 extends through the sleeve. The sleeve facilitates the rotation of the fixing shaft inside the accommodating cavity.

In an example embodiment, with reference to FIG. 5, the support ring 22 is fixed to the inner inlet casing 30 via a bolt 50.

An example embodiment of the present invention further provides a gas turbine, comprising an inner inlet casing 30, an outer inlet casing 40 and an inlet guide vane assembly as described above. The outer inlet casing 40 is sheathed outside the inner inlet casing 30, and the outer inlet casing 40 comprises a cylindrical fixing part 42. One end of each of the inlet guide vanes 10 is rotatably connected to the first fixing part, each of the inlet guide vanes 10 is rotatable in a radial direction of the fixing part 42, and the support ring 22 is fixed to the inner inlet casing 30.

It should be understood that, although the description is given according to the embodiments, each embodiment does not merely comprise one independent technical solution, and this narrative manner of the description is merely for clarity. A person skilled in the art should take the description as a whole, and technical solutions in the embodiments can also be appropriately combined to form other implementations that can be understood by a person skilled in the art.

The detailed descriptions set forth above are merely specific descriptions directed to the feasible embodiments of the present invention, and they are not intended to limit the scope of protection of the present invention. Any equivalent implementation or change, such as combination, division or repetition of features, made without departing from the technical spirit of the present invention shall be included within the scope of protection of the present invention.

The invention claimed is:

1. An inlet guide vane assembly of a gas turbine, the gas turbine including an inner inlet casing and an outer inlet casing, the outer inlet casing being sheathed outside the inner inlet casing, the outer inlet casing including a cylindrical fixing part, the inlet guide vane assembly comprising:

a plurality of inlet guide vanes, one end of each of the plurality of inlet guide vanes being rotatably connected to a first fixing part, each of the plurality of inlet guide vanes being rotatable in a radial direction of the cylindrical fixing part, each of the plurality of inlet guide vanes including a fixing shaft, each respective fixing shaft being respectively disposed at an end of each respective inlet guide vane, of the plurality of inlet guide vanes, away from the cylindrical fixing part; and a fixing assembly comprising:

a support ring, coaxially fixable to the inner inlet casing with the cylindrical fixing part, the support ring including a support part formed by radially extending from an outer surface of the support ring, and the support part including a support wall facing towards the inner inlet casing, a fixing ring, sheathed on an outer surface of the support ring and located between the inner inlet casing and the support part, the fixing ring including a fixing wall facing towards the support part, the fixing wall forming, in cooperation with the support wall, a plurality of accommodating cavities respectively corresponding to the plurality of inlet guide vanes, after making contact with the support wall, and the fixing shafts being rotatably inserted into the plurality of accommodating cavities, and an abutting member, disposed between the inner inlet casing and the fixing ring in an axial direction of the support ring, the abutting member being in interference fit with the inner inlet casing and the fixing ring.

2. The inlet guide vane assembly of a gas turbine of claim 1, wherein the support ring and the fixing ring are respectively assembled by two semi-rings.

3. The inlet guide vane assembly of a gas turbine of claim 2, wherein the abutting member is a metal strip wound around the support ring.

4. The inlet guide vane assembly of a gas turbine of claim 3, wherein a raised edge, extending towards the inner inlet casing, is formed on the abutting member, and the raised edge embeddable into the inner inlet casing.

5. The inlet guide vane assembly of a gas turbine of claim 1, wherein the support wall includes a plurality of first grooves, and wherein the fixing wall includes a plurality of second grooves corresponding to the plurality of first grooves, the plurality of first grooves and the plurality of second grooves respectively cooperating to form the plurality of accommodating cavities.

6. The inlet guide vane assembly of a gas turbine of claim 5, wherein a sleeve is disposed within each of the plurality of accommodating cavities, and the fixing shaft extending through the sleeve.

7. The inlet guide vane assembly of a gas turbine of claim 1, wherein the support ring is fixed to the inner inlet casing via a bolt.

8. A gas turbine, comprising:

an inner inlet casing;

an outer inlet casing sheathed outside the inner inlet casing, the outer inlet casing including a cylindrical fixing part; and the inlet guide vane assembly of claim 1, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

9. A gas turbine, comprising:

an inner inlet casing;

an outer inlet casing sheathed outside the inner inlet casing, the outer inlet casing including a cylindrical fixing part; and the inlet guide vane assembly of claim 2, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

10. A gas turbine, comprising:

an inner inlet casing;

an outer inlet casing sheathed outside the inner inlet casing, the outer inlet casing including a cylindrical fixing part; and the inlet guide vane assembly of claim 3, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

11. A gas turbine, comprising:

an inner inlet casing;

an outer inlet casing sheathed outside the inner inlet casing, the outer inlet casing including a cylindrical fixing part; and the inlet guide vane assembly of claim 4, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

12. A gas turbine, comprising:

an inner inlet casing;

an outer inlet casing sheathed outside the inner inlet casing, the outer inlet casing including a cylindrical fixing part; and the inlet guide vane assembly of claim 5, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

13. A gas turbine, comprising:

an inner inlet casing;

an outer inlet casing sheathed outside the inner inlet casing, the outer inlet casing including a cylindrical fixing part; and the inlet guide vane assembly of claim 6, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

14. A gas turbine, comprising:

an inner inlet casing;

an outer inlet casing sheathed outside the inner inlet casing, the outer inlet casing including a cylindrical fixing part; and the inlet guide vane assembly of claim 7, wherein one end of each of the plurality of inlet guide vanes is rotatably connected to the first fixing part, each of the plurality of inlet guide vanes being rotatable in a radial direction of the cylindrical fixing part, and the support ring being fixed to the inner inlet casing.

* * * * *